US008548654B2

(12) United States Patent
Katsuta et al.

(10) Patent No.: US 8,548,654 B2
(45) Date of Patent: Oct. 1, 2013

(54) SIGNALING SYSTEM

(75) Inventors: Keiichi Katsuta, Kawasaki (JP); Dai Watanabe, Hitachi (JP); Yoichi Sugita, Tokai (JP)

(73) Assignee: Hitachi, Ltd., Tokyo (JP)

( * ) Notice: Subject to any disclaimer, the term of this patent is extended or adjusted under 35 U.S.C. 154(b) by 922 days.

(21) Appl. No.: 11/640,963

(22) Filed: Dec. 19, 2006

(65) Prior Publication Data

US 2007/0162199 A1 Jul. 12, 2007

(30) Foreign Application Priority Data

Dec. 22, 2005 (JP) ..... 2005-368989

(51) Int. Cl.
*G05D 1/00* (2006.01)

(52) U.S. Cl.
USPC ..... 701/19; 701/20; 246/3; 246/4; 246/5; 246/6; 246/7; 246/24; 246/62; 246/177; 246/182 R; 246/26; 340/933

(58) Field of Classification Search
USPC ..... 701/19, 20; 246/1 R, 2 R, 3
See application file for complete search history.

(56) References Cited

U.S. PATENT DOCUMENTS 3,662,167 A * 5/1972 Elcan et al. ..... 246/2 F
5,467,945 A * 11/1995 Kubota et al. ..... 246/26
5,533,695 A * 7/1996 Heggestad et al. ..... 246/62
2005/0001741 A1* 1/2005 Taoka et al. ..... 340/933
2006/0195236 A1* 8/2006 Katsuta et al. ..... 701/19

FOREIGN PATENT DOCUMENTS

JP 02-109769 A 4/1990
JP 5-213202 A 8/1993
JP 7-41840 B2 5/1995

OTHER PUBLICATIONS

Japanese Office Action dated Jan. 25, 2011 with partial English translation (four (4) pages).

* cited by examiner

*Primary Examiner* — Redhwan k Mawari
(74) *Attorney, Agent, or Firm* — Crowell & Moring LLP

(57) ABSTRACT

A message that contains train on-track information and reservation information of a train detection section and direction information and reservation information of a switch is circulated among a train detector, switch machine, signal device controller and a route indicating device. Via a signaling message, the train detector transmits the train detection result to the signal device controller and the route indicating device, the switch machine can transmit switch condition to the signal device controller, the route indicating device transmits route reservation to the switch machine and the signal device controller. Based on the transmitted train detection result, switch condition and route reservation condition, the signal device controller transmits travel permission or travel non-permission for the assigned route to a train.

10 Claims, 14 Drawing Sheets

| CONTENT | | | |
|---|---|---|---|
| TRAIN DETECTION SECTION INFORMATION | TRAIN ON-TRACK INFORMATION | 1T | |
| | | 2T | |
| | | 3T | |
| | | 4T | |
| | RESERVATION INFORMATION | 1T | |
| | | 2T | |
| | | 3T | |
| | | 4T | |
| TRAVEL TRACK SWITCH INFORMATION | DIRECTION INFORMATION | 1S | |
| | RESERVATION INFORMATION | 1S | |

FIG. 7

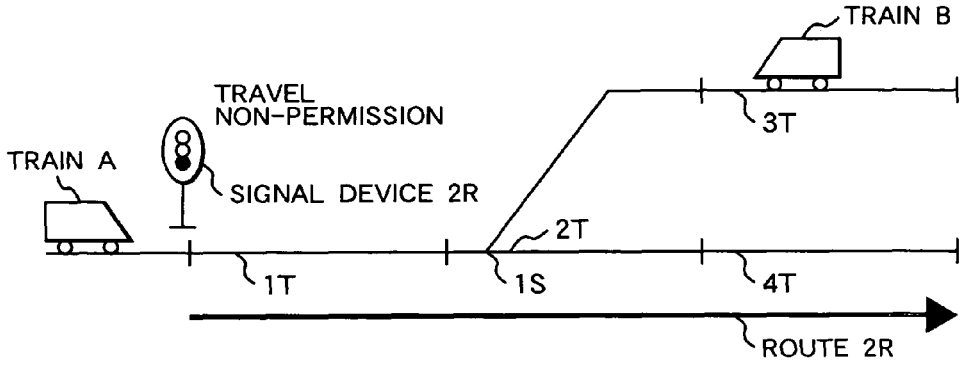

| | | | | |
|---|---|---|---|---|
| TRAIN DETECTION SECTION INFORMATION | TRAIN ON-TRACK INFORMATION | 1T | ABSENCE ON THE TRACK | ROUTE 2R RESERVATION CONDITIONS |
| | | 2T | ABSENCE ON THE TRACK | |
| | | 3T | PRESENCE ON THE TRACK | |
| | | 4T | ABSENCE ON THE TRACK | |
| | RESERVATION INFORMATION | 1T | NON-RESERVATION | |
| | | 2T | NON-RESERVATION | |
| | | 3T | NON-RESERVATION | |
| | | 4T | NON-RESERVATION | |
| TRAVEL TRACK SWITCH INFORMATION | DIRECTION INFORMATION | 1S | NON-CLEAR | |
| | RESERVATION INFORMATION | 1S | NON-RESERVATION | |

FIG. 8

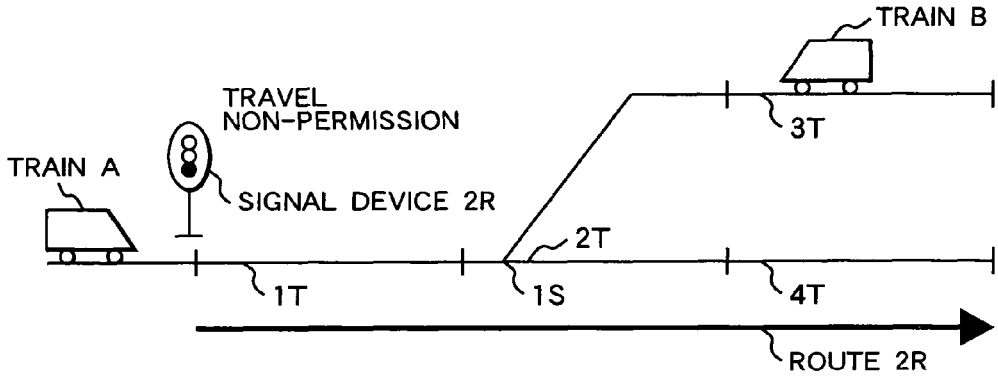

| | | | |
|---|---|---|---|
| TRAIN DETECTION SECTION INFORMATION | TRAIN ON-TRACK INFORMATION | 1T | ABSENCE ON THE TRACK |
| | | 2T | ABSENCE ON THE TRACK |
| | | 3T | PRESENCE ON THE TRACK |
| | | 4T | ABSENCE ON THE TRACK |
| | RESERVATION INFORMATION | 1T | ROUTE 2R RESERVED |
| | | 2T | ROUTE 2R RESERVED |
| | | 3T | NON-RESERVATION |
| | | 4T | ROUTE 2R RESERVED |
| TRAVEL TRACK SWITCH INFORMATION | DIRECTION INFORMATION | 1S | NON-CLEAR |
| | RESERVATION INFORMATION | 1S | NORMAL POSITION RESERVED |

UPDATED BY ROUTE INDICATING DEVICE

FIG. 9

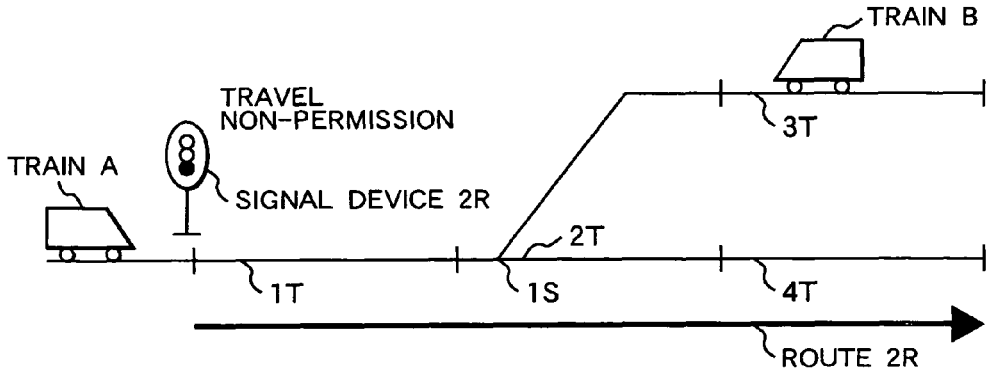

| | | | |
|---|---|---|---|
| TRAIN DETECTION SECTION INFORMATION | TRAIN ON-TRACK INFORMATION | 1T | ABSENCE ON THE TRACK |
| | | 2T | ABSENCE ON THE TRACK |
| | | 3T | PRESENCE ON THE TRACK |
| | | 4T | ABSENCE ON THE TRACK |
| | RESERVATION INFORMATION | 1T | ROUTE 2R RESERVED |
| | | 2T | ROUTE 2R RESERVED |
| | | 3T | NON-RESERVATION |
| | | 4T | ROUTE 2R RESERVED |
| TRAVEL TRACK SWITCH INFORMATION | DIRECTION INFORMATION | 1S | NON-CLEAR |
| | RESERVATION INFORMATION | 1S | NORMAL POSITION RESERVED → NORMAL POSITION CHANGE CONDITIONS |

FIG. 10

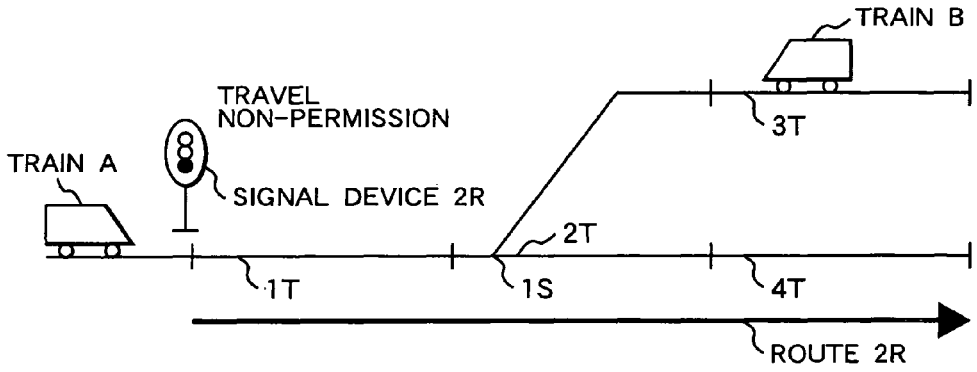

| | | | |
|---|---|---|---|
| TRAIN DETECTION SECTION INFORMATION | TRAIN ON-TRACK INFORMATION | 1T | ABSENCE ON THE TRACK |
| | | 2T | ABSENCE ON THE TRACK |
| | | 3T | PRESENCE ON THE TRACK |
| | | 4T | ABSENCE ON THE TRACK |
| | RESERVATION INFORMATION | 1T | ROUTE 2R RESERVED |
| | | 2T | ROUTE 2R RESERVED |
| | | 3T | NON-RESERVATION |
| | | 4T | ROUTE 2R RESERVED |
| TRAVEL TRACK SWITCH INFORMATION | DIRECTION INFORMATION | 1S | NORMAL POSITION |
| | RESERVATION INFORMATION | 1S | NORMAL POSITION RESERVED → UPDATED BY SWITCH MACHINE |

FIG. 11

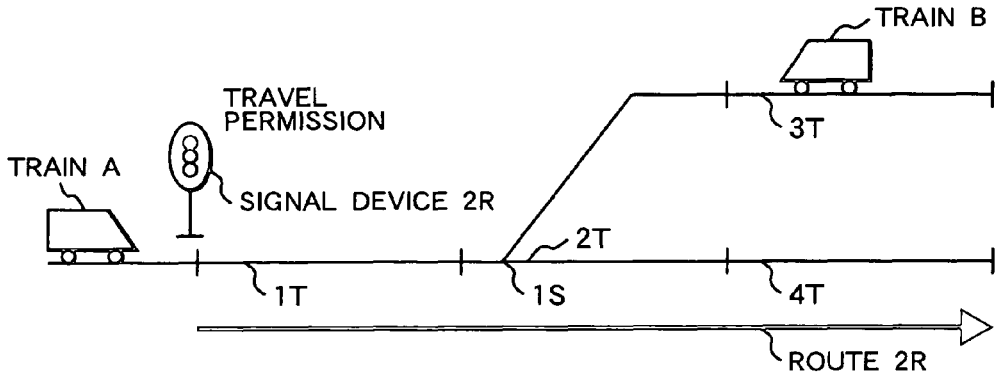

| | | | | |
|---|---|---|---|---|
| TRAIN DETECTION SECTION INFORMATION | TRAIN ON-TRACK INFORMATION | 1T | ABSENCE ON THE TRACK | SIGNAL DEVICE 2R TRAVEL PERMISSION CONDITIONS |
| | | 2T | ABSENCE ON THE TRACK | |
| | | 3T | PRESENCE ON THE TRACK | |
| | | 4T | ABSENCE ON THE TRACK | |
| | RESERVATION INFORMATION | 1T | ROUTE 2R RESERVED | |
| | | 2T | ROUTE 2R RESERVED | |
| | | 3T | NON-RESERVATION | |
| | | 4T | ROUTE 2R RESERVED | |
| TRAVEL TRACK SWITCH INFORMATION | DIRECTION INFORMATION | 1S | NORMAL POSITION | |
| | RESERVATION INFORMATION | 1S | NORMAL POSITION RESERVED | |

FIG. 12

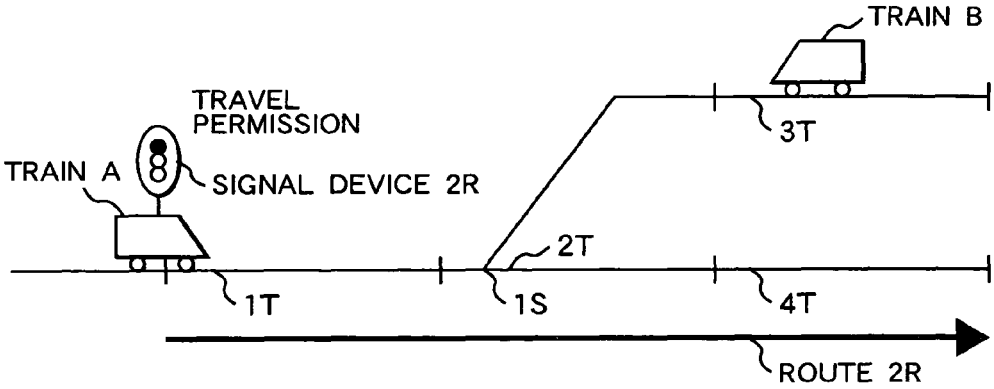

| | | | | |
|---|---|---|---|---|
| TRAIN DETECTION SECTION INFORMATION | TRAIN ON-TRACK INFORMATION | 1T | PRESENCE ON THE TRACK | ← UPDATED BY TRAIN DETECTOR |
| | | 2T | ABSENCE ON THE TRACK | |
| | | 3T | PRESENCE ON THE TRACK | |
| | | 4T | ABSENCE ON THE TRACK | |
| | RESERVATION INFORMATION | 1T | ROUTE 2R RESERVED | |
| | | 2T | ROUTE 2R RESERVED | |
| | | 3T | NON-RESERVATION | |
| | | 4T | ROUTE 2R RESERVED | |
| TRAVEL TRACK SWITCH INFORMATION | DIRECTION INFORMATION | 1S | NORMAL POSITION | |
| | RESERVATION INFORMATION | 1S | NORMAL POSITION RESERVED | |

FIG. 13

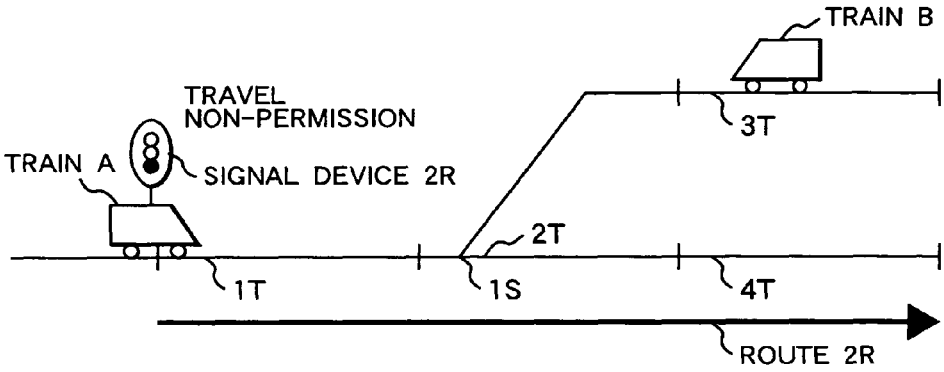

| | | | |
|---|---|---|---|
| TRAIN DETECTION SECTION INFORMATION | TRAIN ON-TRACK INFORMATION | 1T | PRESENCE ON THE TRACK |
| | | 2T | ABSENCE ON THE TRACK |
| | | 3T | PRESENCE ON THE TRACK |
| | | 4T | ABSENCE ON THE TRACK |
| | RESERVATION INFORMATION | 1T | ROUTE 2R RESERVED |
| | | 2T | ROUTE 2R RESERVED |
| | | 3T | NON-RESERVATION |
| | | 4T | ROUTE 2R RESERVED |
| TRAVEL TRACK SWITCH INFORMATION | DIRECTION INFORMATION | 1S | NORMAL POSITION |
| | RESERVATION INFORMATION | 1S | NORMAL POSITION RESERVED |

SIGNAL DEVICE 2R TRAVEL PERMISSION CONDITIONS UNESTABLISHED

FIG. 14

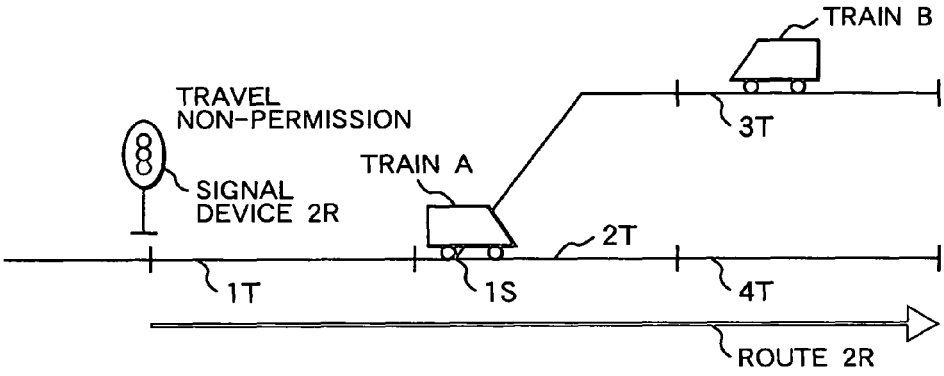

| | | | | |
|---|---|---|---|---|
| TRAIN DETECTION SECTION INFORMATION | TRAIN ON-TRACK INFORMATION | 1T | ABSENCE ON THE TRACK | UPDATED BY TRAIN DETECTOR |
| | | 2T | PRESENCE ON THE TRACK | |
| | | 3T | PRESENCE ON THE TRACK | |
| | | 4T | ABSENCE ON THE TRACK | |
| | RESERVATION INFORMATION | 1T | NON-RESERVATION | |
| | | 2T | ROUTE 2R RESERVED | |
| | | 3T | NON-RESERVATION | |
| | | 4T | ROUTE 2R RESERVED | |
| TRAVEL TRACK SWITCH INFORMATION | DIRECTION INFORMATION | 1S | NORMAL POSITION | |
| | RESERVATION INFORMATION | 1S | NORMAL POSITION RESERVED | |

FIG. 15

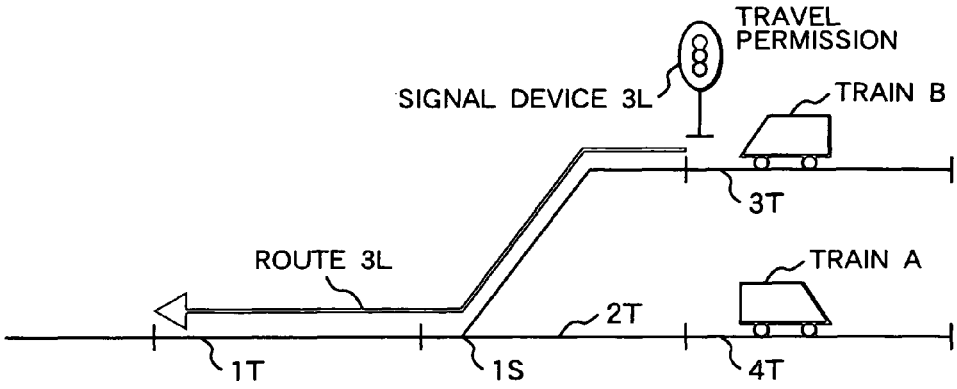

| | | | |
|---|---|---|---|
| TRAIN DETECTION SECTION INFORMATION | TRAIN ON-TRACK INFORMATION | 1T | ABSENCE ON THE TRACK |
| | | 2T | ABSENCE ON THE TRACK |
| | | 3T | PRESENCE ON THE TRACK |
| | | 4T | PRESENCE ON THE TRACK |
| | RESERVATION INFORMATION | 1T | ROUTE 3L RESERVED |
| | | 2T | ROUTE 3L RESERVED |
| | | 3T | NON-RESERVATION |
| | | 4T | ROUTE 2R RESERVED |
| TRAVEL TRACK SWITCH INFORMATION | DIRECTION INFORMATION | 1S | REVERSE POSITION |
| | RESERVATION INFORMATION | 1S | REVERSE POSITION RESERVED |

SIGNAL DEVICE 3L TRAVEL PERMISSION CONDITIONS

SIGNALING SYSTEM

CLAIM OF PRIORITY

The present application claims priority from Japanese application serial no. 2005-368989, filed on Dec. 22, 2005, the content of which is hereby incorporated by reference into this application.

FIELD OF THE INVENTION

The present invention relates to a signaling system used in the operation of trains, monorail, LRT (Light Rail Transit), AGT (Automated Guided Train), and the like.

BACKGROUND OF THE INVENTION

In the railway system, a system has been established wherein an interlocking device is conventionally used as a core of the signaling system so that it links and connects to a track circuit for detecting the presence of a train on the track, a point for switching railway tracks, and a signal device for transmitting permission for a train to proceed or not proceed along a track and does not allow a train to enter a track if there is danger of a collision or derailment.

Recently, as disclosed in Japanese Patent publication No. 7-41840, a method has been developed wherein a central apparatus wirelessly detects a train's location from an on-board device, and based on that train's location, the central apparatus links and controls a point and an on-board signal device.

SUMMARY OF THE INVENTION

The core of the conventional signaling system is an interlocking device. The interlocking device is equipped with an input/output means for communicating with all of the railway devices, such as track circuits, points, and signal devices, disposed in the control area and creates logic to link and control those devices so as to prevent trains from colliding or derailing by using a relay and a computer. Inevitably, the incorporated connection theory is large and complicated, requiring an enormous cost for designing and producing the logic. Also, a tremendous amount of cable wiring to connect those railway devices becomes necessary which requires an enormous cost for the cable routing and its maintenance.

Furthermore, in a method that has been developed recently, the signal logic which is based on the location information sent from a train and connects and controls points and signal devices in order to prevent the train from colliding or derailing is huge and complicated, requiring a large apparatus. As a result, an enormous cost is necessary for designing such logic and producing such apparatus.

The objective of the present invention is to provide a signaling system which achieves inexpensive design cost and production cost.

To solve the above problem, a signaling system according to the present invention comprises a railway device that exists in a predetermined section and a route indicating device that exists in the predetermined section and instructs a train route, wherein a message that is circulated between the railway device and the route indicating device includes condition information and reservation information of the railway device.

Furthermore, the signaling system according to the present invention comprises a train presence recognition device which is disposed on a train and can detect the location of a train on the track, a railway device that exists in a predetermined section, and a route indicating device that exists in the predetermined section and instructs a train route; wherein a message that is circulated among the train presence recognition device disposed on a train which exists in the predetermined section, the railway device, and the route indicating device includes train on-track information indicating whether a train exists on the track in each of a plurality of subsections which compose the predetermined section, track reservation information indicating whether the track is reserved for the train in each of a plurality of subsections which compose the predetermined section, and condition information and reservation information of the railway device; and the train presence recognition device comprises a function to update train on-track information and track reservation information contained in the message based on the detected location of the train itself.

Furthermore, the signaling system according to the present invention comprises a train presence recognition device that is disposed on a train and can detect the location of a train on the track, a signal device controller that is disposed on a train and controls a signal device, a switch machine that exists in a predetermined section and controls a point, and a route indicating device that exists in the predetermined section and instructs a train route; wherein a message that is circulated among the train presence recognition device and the signal device controller disposed on the train that exists in the predetermined section, the switch machine, and the route indicating device includes train on-track information indicating whether a train exists on the track in each of a plurality of subsections which compose the predetermined section, track reservation information indicating whether the track is reserved for the train in each of a plurality of subsections which compose the predetermined section, direction information indicating to which direction the point is oriented, and direction reservation information indicating to which direction the point is reserved; and the train presence recognition device comprises a function to update train on-track information and track reservation information contained in the message based on the detected location of the train itself.

According to the present invention, it is possible to provide a signaling system which achieves inexpensive design cost and production cost.

BRIEF DESCRIPTION OF THE DRAWINGS

FIG. 7 explains the mechanism of securing safe operation of trains in the present invention.

FIG. 8 explains the mechanism of securing safe operation of trains in the present invention.

FIG. 9 explains the mechanism of securing safe operation of trains in the present invention.

FIG. 10 explains the mechanism of securing safe operation of trains in the present invention.

FIG. 11 explains the mechanism of securing safe operation of trains in the present invention.

FIG. 12 explains the mechanism of securing safe operation of trains in the present invention.

FIG. 13 explains the mechanism of securing safe operation of trains in the present invention.

FIG. 14 explains the mechanism of securing safe operation of trains in the present invention.

FIG. 15 explains the mechanism of securing safe operation of trains in the present invention.

DESCRIPTION OF THE PREFERRED EMBODIMENTS

Figure 1:
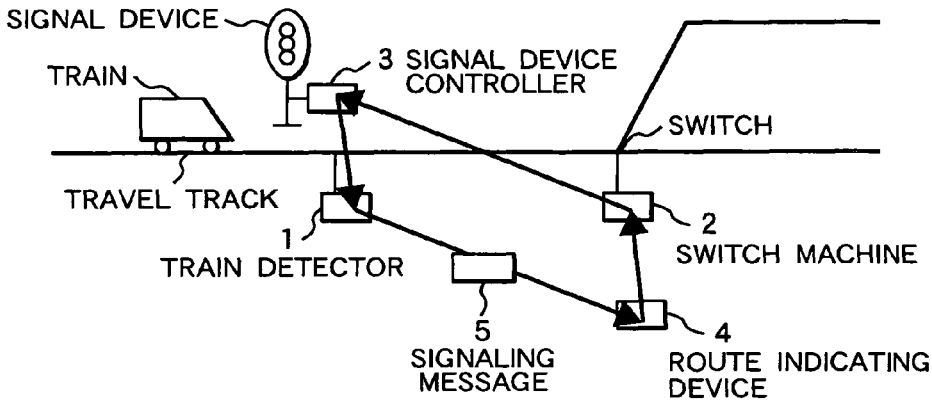
FIG. 1 shows an embodiment of a signaling system according to the present invention.

The configuration of a signaling system according to an embodiment of the present invention is shown in FIG. 1.

Railway devices that compose a signaling system of this embodiment include a train detector, point, switch machine for controlling the point, signal device, and a signal device controller for controlling the signal device.

A signaling system according to this embodiment comprises a plurality of railway devices disposed in a predetermined section, such as a train detector 1 for detecting the location of a train on the travel track, switch machine 2 for controlling a point that switches travel tracks, and a signal device controller 3 for controlling a signal device and transmitting travel permission or travel non-permission to the train; a route indicating device 4 which is disposed in the same predetermined section and indicates the direction along which the train proceeds by receiving a train route instruction from an operator or the like; and a signaling message 5 which is circulated among the train detector 1, switch machine 2, signal device controller 3 and route indicating device 4. Thus, by circulating a message among the train detector 1, switch machine 2, signal device controller 3 and route indicating device 4 so that each device can process information in a decentralized manner, it is possible to decrease the size of the logic incorporated into each device and the device itself. As a result, it is possible to provide a signaling system which keeps design cost and production cost low.

Herein, the signaling message 5 is a message for establishing a signalling system; and hereafter, it is referred to as a message or a signaling message.

Figure 2:
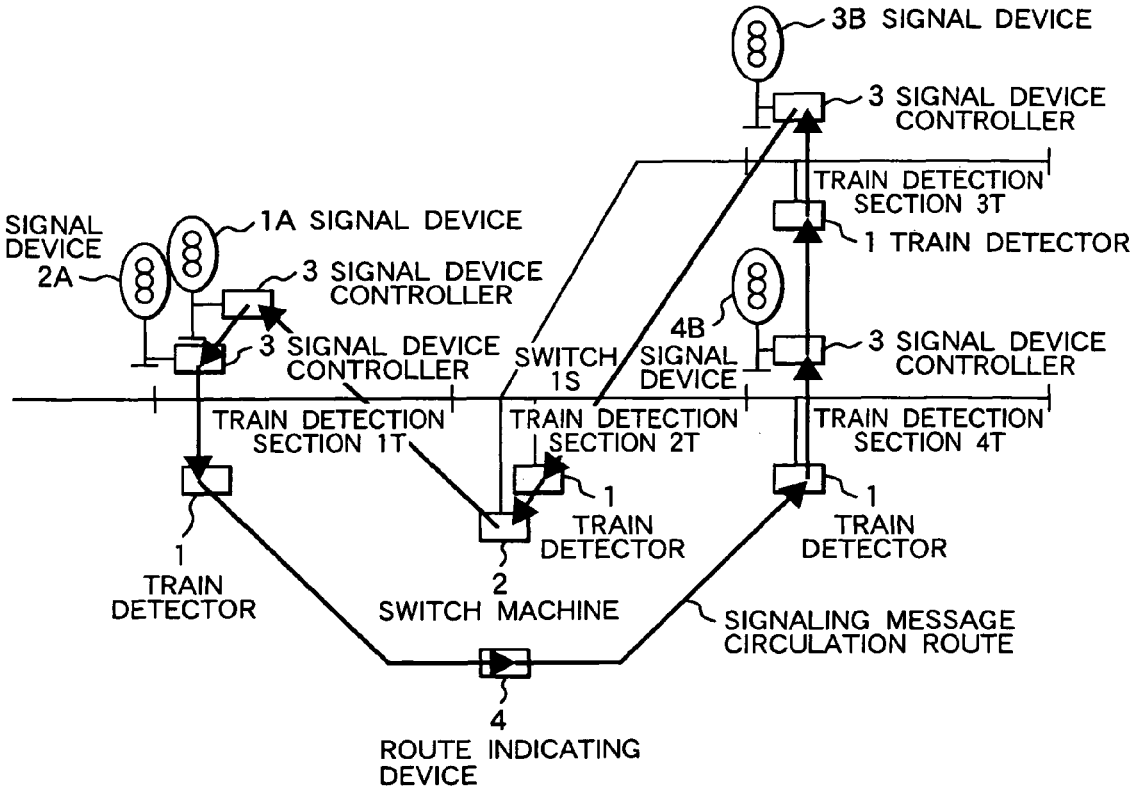
FIG. 2 shows an embodiment of a signaling message circulation route used in a signaling system according to the present invention.

In this embodiment, a situation is assumed in which, as shown in FIG. 2, a station that has one switch on the travel track (predetermined section) is further divided into a plurality of predetermined subsections (herein, four train detection sections) and four signal devices are disposed. It is possible to divide the train detection section into a larger number of subsections. When the train detection section is divided into a larger number of subsections, a moving block signaling system will result.

With regard to the direction of a switch, the normal direction is called "normal position," and the other direction is called "reverse position." In this embodiment, the direction of a switch along which the direction of travel track is a straight line is called "normal position," and a direction other than that direction is called "reverse position."

Figure 3:
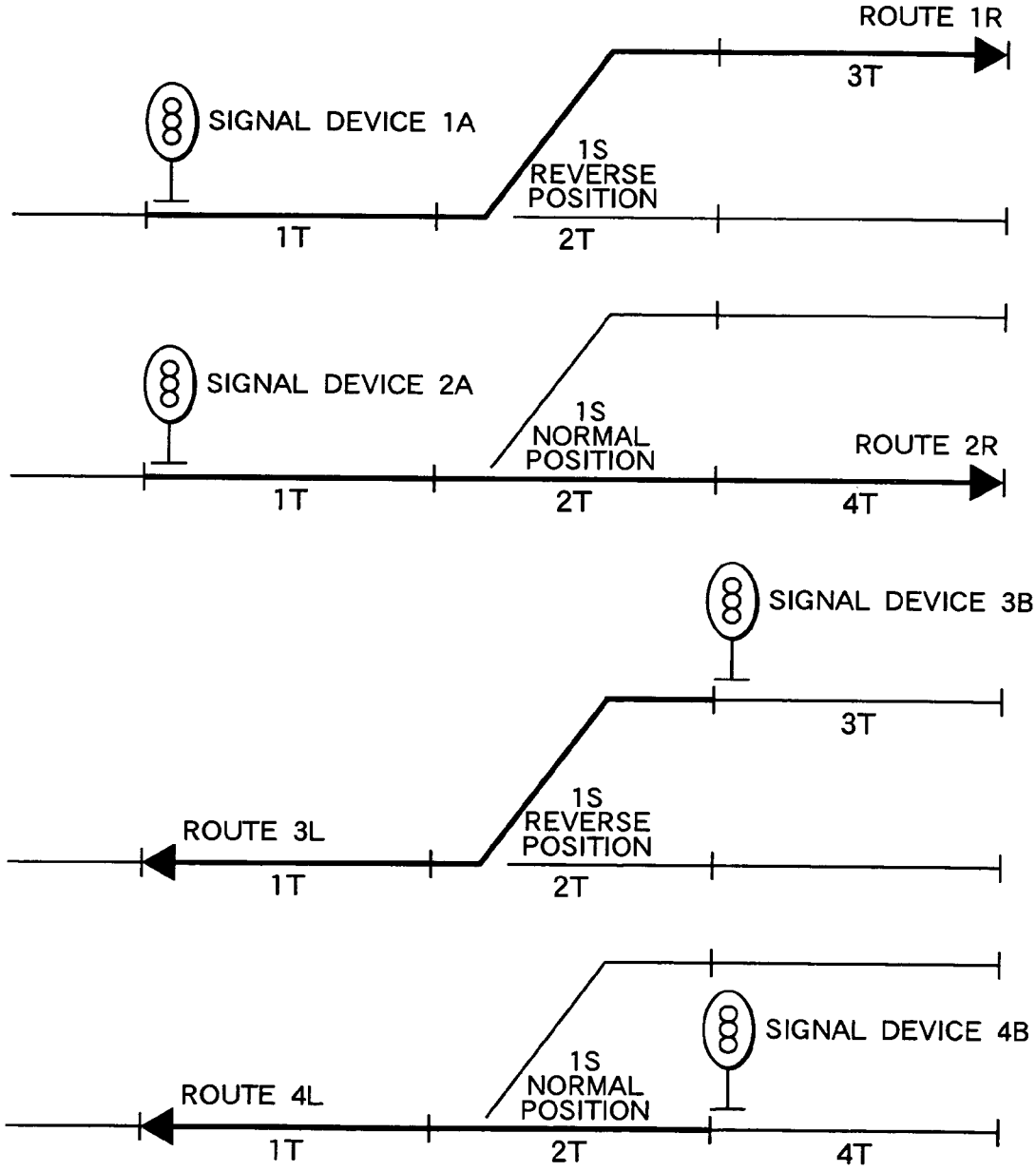
FIG. 3 shows an assigned route of each signal device in the signaling system shown in FIG. 2.

As shown in FIG. 3, the signal device 1A sets the switch 1S at a reverse position and controls route 1R that goes from train detection section 1T to 2T and to 3T; the signal device 2A sets the switch 1S at a normal position and controls route 2R that goes from 1T to 2T and to 4T; the signal device 3B sets the switch 1S at a reverse position and controls route 3L that goes from 2T to 1T; and the signal device 4B sets the switch 1S at a normal position and controls route 4L that goes from 2T to 1T. Each train detection section has a train detector 1, each switching point has a switch machine 2, each signal device has a signal device controller 3, and an operation room has a route indicating device 4. The train detector 1, switch machine 2, signal device controller 3, and the route indicating device 4 are connected to one another by a communication means provided for each device so that a signaling message can be circulated. In this embodiment, as shown in FIG. 2, a signaling message is circulated. The signaling message circulation route can be set flexibly, and in some devices, the message can be circulated two or more times during one cycle. In this case, depending on the location of the devices, the communication distance can be reduced thereby decreasing communication cost.

Figure 4A:
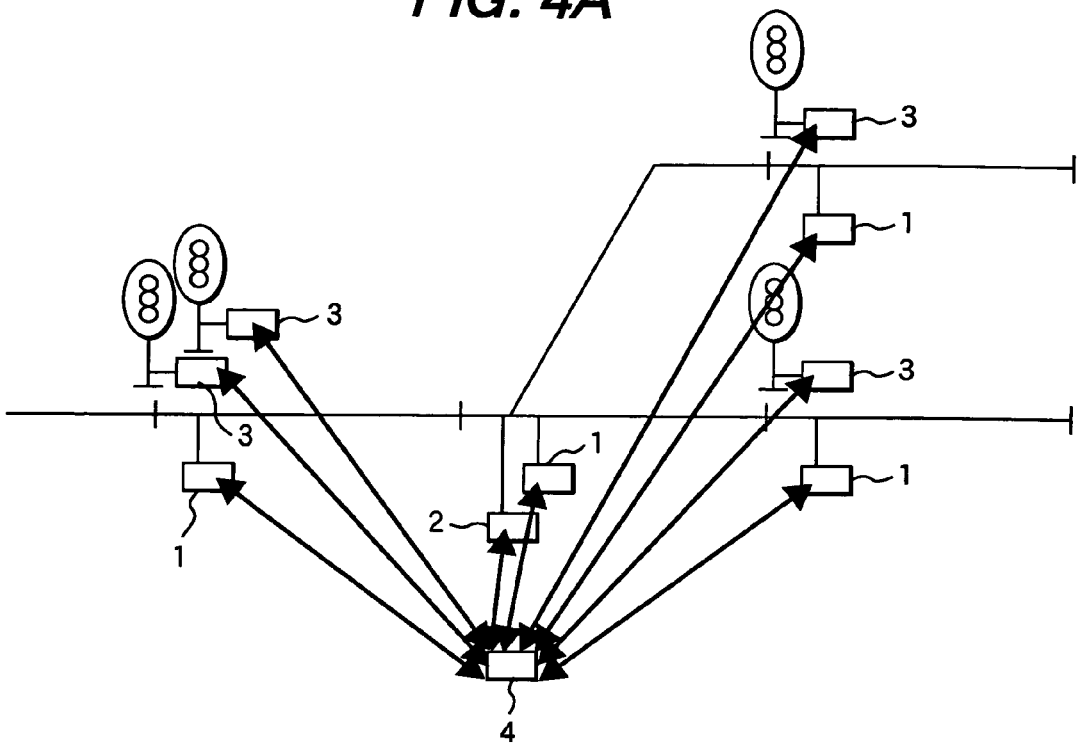
FIG. 4A shows another first embodiment of a signaling system according to the present invention.

As shown in FIG. 4A, another first embodiment can be considered in which one main device alternately sends and receives a signaling message to and from other devices. In this case, the main device can always detect signaling-message update conditions and communication path conditions. Furthermore, each device can be equipped with a means for changing a signaling message circulation route. In this case, when a part of the communication path is disconnected, it is possible to still transmit the signaling message by detouring it. The communication means which transmits a signaling message among those devices can either be wired by using a telephone line or a LAN or be wireless by using wireless LAN, satellite, LCX or cellular phone. It is also possible for both systems to be combined.

Figure 4B:
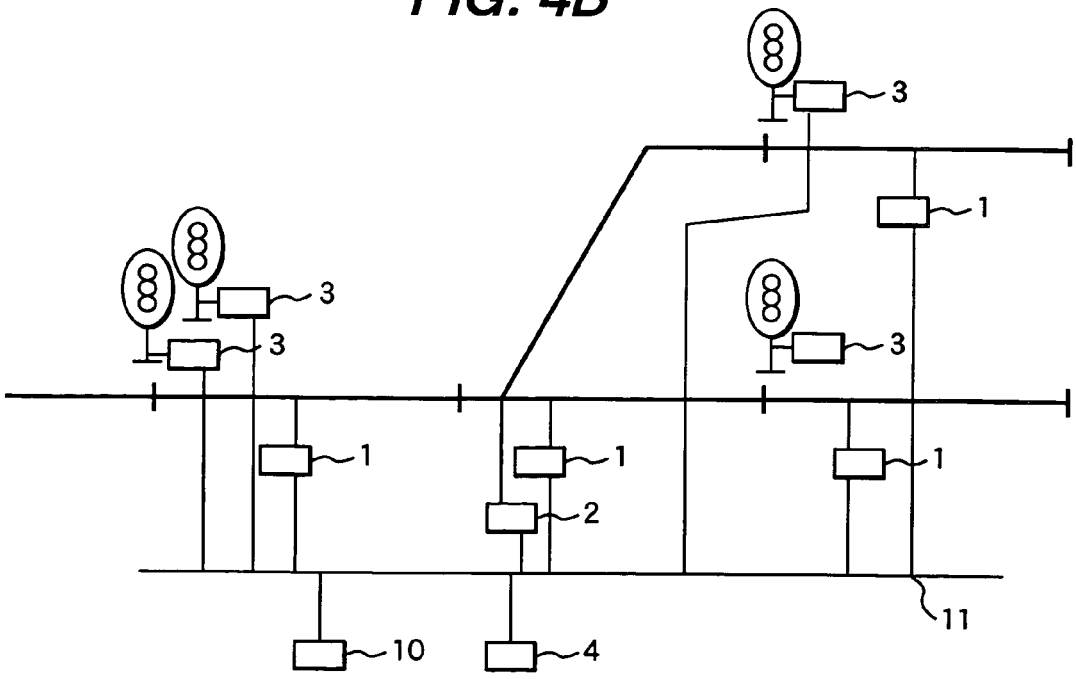
FIG. 4B shows another second embodiment of a signaling system according to the present invention.

Furthermore, as an another second example of the configuration that includes a communication means for transmitting a signaling message among devices, there is proposed a signaling device, shown in FIG. 4B, in which the central interlocking device 10 is connected to on-site devices by means of a network 11. In this configuration, normal operations include the transmission of a control message from the interlocking device 10 to the signal device controller 3 and the route indicating device 4 and the transmission of a display information message from the train detector 1, signal device controller 3, and the route indicating device 4 to the interlocking device 10. Herein, the train detector 1, signal device controller 3 and the route indicating device 4 are generically named as "on-site devices." When an interlocking device exists as a central apparatus, on-site devices do not communicate with one another via a network 11. However, when a function is provided that enables the on-site devices to directly communicate via the network 11, the present invention functions as a means for backing up a signaling device that applies the network. This means that the central interlocking device 10 normally controls the operations of on-site devices as in the same manner as a conventional signaling device, and in the event the interlocking device 10 stops operating due to a failure or some other reason, the function according to the present invention can maintain communication connection for transmitting a signaling message among the on-site devices. To do so, each on-site device must have a detection function for detecting whether the central interlocking device is operating normally.

Because an interlocking device generally communicates with on-site devices at a constant cycle, when communication with the interlocking device is disconnected for a certain period of time, on-site devices determine that the central interlocking device has failed and switch the signaling control logic of the on-site devices.

Figures 5, 6:
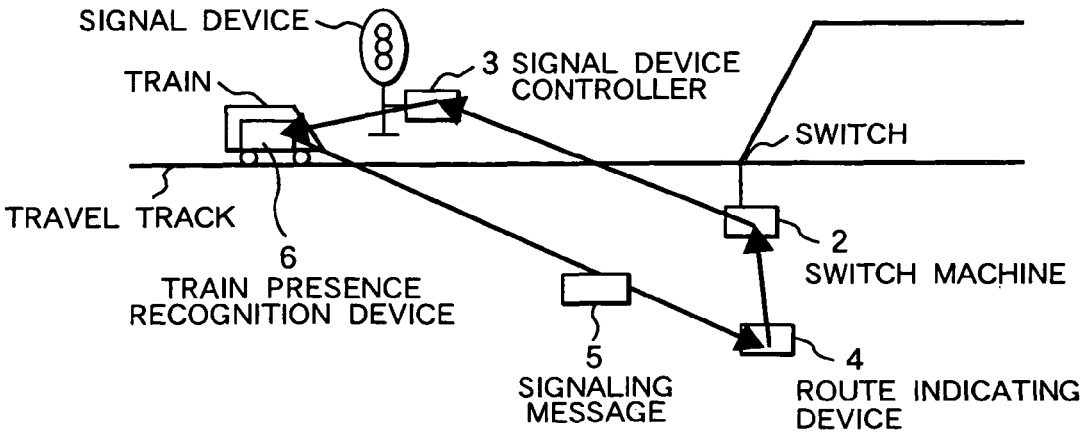
FIG. 5 shows an embodiment of a signaling message used in the signaling system shown in FIG. 2.
FIG. 6 shows another embodiment of a signaling system according to the present invention.

As shown in FIG. 5, the content of the signaling message includes train detection section information and travel track switch information. Train detection section information comprises train on-track information and reservation information of each train detection section. The train on-track information, which is train detector 1 condition information, indicates that a train is present on the track in the corresponding train detection section, and the train detection result obtained by the train detector 1 is applied. The reservation information is track reservation information which indicates whether the train has reserved the track for each indicated train detection section, and the data inputted into the route indicating device 4 is applied. Moreover, a plurality of reservations for the same section cannot be permitted. Travel track switch information comprises the point's direction information and reservation information at each switch. The direction information, which is switch machine condition information, indicates the direction of the point at the corresponding switch, and the condition inspection result obtained by the switch machine is applied. The reservation information is direction reservation information that indicates in which direction the point is reserved at the corresponding switch, and the data inputted into the route indicating device 4 is applied. Moreover, a signaling message can be divided into a plurality of submessages to avoid duplication of management information. In this case, it is possible to decrease the amount of information per signaling message, resulting in communication cost reduction.

The train detector 1 has a train detection means for detecting the presence of a train on the track in its assigned section. For example, the train detection means can be a means that electrically insulates the rail in the same manner as a track circuit and connects a power source to one end and a relay to the other end thereby detecting a short circuit between rails caused by a train axle; and it can also be a means that has a receiver on each end of the section or a loop coil of the same length as the section length and conducts electromagnetic induction via an antenna disposed on the train thereby detecting the entrance and departure of the train. When the train detector 1 receives a signaling message, it updates its own section's train on-track information contained in the signaling message according to the condition of the train detector 1. For example, when a train has not been detected, that information is updated to "absence on the track" and in other cases, that information is updated to "presence on the track." At this time, when updated information changes from "presence on the track" to "absence on the track," reservation information of its own section is simultaneously updated to "non reservation." The signaling message thus updated is then sent to the subsequent device.

Furthermore, instead of placing a train detector 1 on a travel track, it is possible to provide an on-board train presence recognition device 6, as shown in FIG. 6, comprising a means for calculating a train detection section in which train itself exists on the track, a means for communicating a signaling message, and a means for updating the signaling message. When the train presence recognition device 6 receives a signaling message, it updates train on-track information, contained in the signaling message, concerning the section in which the train itself exists on the track to "presence on the track" as well as adds the train's own identification number. Within the train on-track information concerning a section in which the train does not exist, if "presence on the track" information along with the train's own identification number exists, the train presence recognition device 6 updates the train on-track information to "absence on the track" and updates reservation information to "non reservation," and then sends that information to the subsequent device. Moreover, when another device has a means for calculating a train detection section in which a train exists on the track based on the train location, it is possible to simply include the train location along with the train's own identification number in the signaling message. The means for calculating a train detection section in which the train itself exists on the track can carry out calculations by referencing the train location detection result with railway track data. For example, a means for detecting a train location includes a means that has data about locations of transponders and tags preinstalled on the ground and detects a train location by using such data, a means for calculating a travel distance by calculating the number of rotations of a moving wheel, and a means for recognizing an absolute location by using a GPS (Global Positioning System).

The switch machine 2 has a means for switching travel tracks. Generally, a point is used for switching travel tracks. The switch machine 2 which receives a signaling message has a function to determine the point's clearing direction based on reservation information contained in the signaling message, and a function to update direction information in the message based on the point's condition. Specifically, when reservation information of its own switch contained in the received signaling message indicates the reservation of normal position, the switch machine 2 changes a travel track so that the switch is oriented to the normal position; and when the reservation of reverse position is indicated, the switch machine 2 changes a travel track so that the switch is oriented to the reverse position. Next, direction information of its own switch contained in the signaling message is updated to "normal position" when the switch is oriented to the normal position, and to "reverse position" when the switch is oriented to the reverse position; and in other cases, the information is updated to "non-clear." The signaling message thus updated is then sent to the subsequent device.

The signal device controller 3 is disposed in the signal device to control the signal device. The signal device has a means for transmitting travel permission or travel non-permission to a train. The signal device controller 3 has a function to determine travel permission or travel non-permission for a train to enter the signal device's assigned area based on condition information and reservation information contained in the message. Generally, in most cases, travel permission is transmitted by turning on a blue signal lamp and travel non-permission is transmitted by turning on a red signal lamp. A plurality of signal device controllers can be disposed, and if a signal device controller is installed on a train, it is possible to transmit "travel permission" or "travel non-permission" to a train operator or a driving device on the train without providing a signal device on the ground. The signal device controller has data concerning a train detection section, switch and the clearing direction in its assigned route. When a signal device controller receives a signaling message, it sends "travel permission" to a train when train on-track information of all train detection sections in the assigned route indicates "absence on the track", reservation information indicates "assigned route reserved," and direction information of all switches in the assigned route indicates "oriented to the clearing direction." In other cases, the signal device controller sends "travel non-permission." Moreover, the signaling message is sent to the subsequent device.

A route indicating device 4 has a function to receive train route instructions from outside, which is a means for receiving an input concerning a route for the train to travel along. For example, a means for receiving an input concerning a route can be a means for receiving a route instruction from an operator or train operator by means of a button, switch, display or a mouse, or a means for receiving a route information from a central traffic control device or a train driving device by providing a means for communicating with a central traffic control device or a train driving device that controls the train operation. A communication function can be provided between the route indicating device 4 and the train or station staff. In this case, it is possible for a train operator or a driving device on the train or station staff away from the route indicating device 4 to issue route instructions. Furthermore, a plurality of route indicating devices 4 can be installed. When a route indicating device 4 is disposed in a plurality of locations, a route instruction can be issued from a plurality of locations, and when it is installed on the train, a route instruction can be issued from a driving device or a train operator on the train. The route indicating device 4 has data about train detection sections, switches and clearing direction with regard to all of the assigned routes. Moreover, the route indicating device 4 has a function to update reservation information of the railway devices contained in the message based on the route instruction. When a route is inputted and also when train on-track information of all train detection sections along the corresponding route indicates "absence on the track" and reservation information indicates "non reservation," the route indicating device 4 that received a signaling message updates information so that reservation information of all train detection sections on the corresponding route indicates "corresponding route reserved" and reservation information of all switches on the corresponding route indicates "clearing direction reserved," and then it sends the message to the subsequent device. In other cases, the original signaling message is sent to the subsequent device. Moreover, the route indicating device can be equipped with a function to determine acceptance or rejection of the route instruction sent from outside based on the railway device condition information and reservation information contained in the message.

The mechanism of securing train operation by a signaling system according to the present invention will be explained with reference to FIGS. 7 through 15 by assuming a case in which a train enters a station shown in FIG. 2. Herein, the assumed case is a case where an operator operates a route indicating device and permits train A to enter a station from outside while train B already exists on the track in the train detection section 3T.

An operator inputs route 2R, which is a route for train A to take, into the route indicating device. When the route indicating device accepts the input and receives a signaling message, if train on-track information of all train detection sections on route 2R (train detection sections 1T, 2T, and 4T) indicates "absence on the track" and reservation information indicates "non reservation," the route indicating device updates reservation information of all train detection sections on route 2R and reservation information of all switches (switch 1S) on route 2R contained in the signaling message, and then sends the information to the subsequent device. FIG. 7 shows the content of the received signaling message. In this case, reservation information of train detection sections 1T, 2T, and 4T is updated to "route 2R reserved," and reservation information of switch 1S is updated to "normal position reserved." FIG. 8 shows the updated content of the signaling message.

The switch machine installed in switch 1S that has received the updated signaling message starts operating so that the switch becomes oriented to the normal position because its own switch's reservation information indicates "normal position reserved." FIG. 9 shows the content of the received signaling message. At the time the signaling message was received, the switch was not oriented to either direction; therefore, its own switch's direction information indicating "non-clear" is sent to the subsequent device.

After switch 1S has been oriented to the normal position and the travel track has been locked, when the switch machine disposed in switch 1S receives a signaling message, it updates its own switch's direction information to "normal position" and sends it to the subsequent device. FIG. 10 shows the content of the updated signaling message.

The signal device controller disposed in the signal device 2R that has received the updated signaling message sends travel permission to train A because train on-track information of all train detection sections on its own signal device's assigned route 2R indicates "absence on the track," reservation information indicates "route 2R reserved," and direction information of all switches on route 2R indicates "clearing direction." FIG. 11 shows the content of the received signaling message.

The above is an explanation of a mechanism for transmitting travel permission for a train to enter a route.

Hereafter, an explanation will be given about the mechanism for how a train that has been given travel permission goes on the route.

When train A enters the train detection section 1T, the train detector disposed in the train detection section 1T detects the presence of the train on the track. When the train detector disposed in the train detection section 1T receives a signaling message, it updates its own section's train on-track information to "presence on the track" and sends the information to the subsequent device. FIG. 12 shows the content of the updated signaling message. The above mechanism can also apply to the train detection sections 2T and 3T.

The signal device 2R that has received the updated signaling message sends travel non-permission to the subsequent train because train on-track information of the train detection section 1T on its own signal device's assigned route 2R indicates "presence on the track." FIG. 13 shows the content of the received signaling message. At this time, after the preceding train has entered a track, in order to prevent the subsequent train from mistakenly interpreting the travel permission for the preceding train as travel permission for the subsequent train itself, it is preferable that the signaling message updated by the train detector be sent to the signal device controller within a very short period of time. Furthermore, it is possible to provide a function to unconditionally transmit "travel non-permission" to a train if the signal device controller has data about a minimum circulation interval which takes into account the signal device's visible distance and the minimum driving interval between the preceding train and the subsequent train, and the signal device controller does not receive a new signaling message that has been circulated among all of the train detection sections on the assigned route after a minimum circulation interval has passed since the previous signaling message was received.

After train A departed from the train detection section 1T, the train detector disposed in the train detection section 1T will not detect the presence of a train on the track. When the train detector disposed on the train detection section 1T receives a signaling message, it updates its own section's train on-track information to "absence on the track" and updates reservation information to "non reservation," and sends the information to the subsequent device. FIG. 14 shows the content of the updated signaling message. The above mechanism can also apply to the train detection section 2T.

Moreover, until train A departs from the train detection section 2T, even if route 3L is inputted into the route indicating device to move train B, train on-track information of at least one of the train detection sections (train detection sections 2T and 1T) on route 3L indicates "presence on the track" or reservation information indicates "route 2R reserved;" therefore, the route indicating device does not update a signaling message to send an instruction for route 3L. On the other hand, if route 3L is inputted into the route indicating device after train A has departed from the train detection section 2T, both the train detection section and the switch are reserved as in the same manner as route 2R reserved for train A. Subsequently, at the time switch 1S is oriented to the reverse position and the travel track is locked, the switch machine installed in switch 1S updates its own switch's direction information contained in the signaling message to "reverse position," and the signal device controller installed in the signal device 3L that received the message sends travel permission to train B. FIG. 15 shows the content of the signaling message.

Thus, in the signaling system according to the present invention, a message simply circulates among a train detector, switch machine, signal device controller and a route indicating device; therefore, it is not necessary to provide a device such as an interlocking device which has an input/output means to communicate with various railway devices, for example, all track circuits, points, and signal devices in the control area. Also, it is not necessary to provide a device that incorporates a logic to safely control points and signal devices based on the track circuit's train on-track information and point-lock information. As a result, the signaling system according to the present invention effectively keeps design cost and production cost low and also ensures safe train operation.

Furthermore, another embodiment other than this embodiment can be considered in which a signaling message does not include switch reservation information, and the switch machine determines a clearing direction based on reservation information of the train detection section to which its own switch belongs. In this case, the switch machine has a means that has data about a train detection section to which its own switch belongs, a route to which its own switch ralates and the clearing direction; and when receiving a signaling message, the means judges the clearing direction based on the reservation information of the train detection section to which its own switch belongs. In the case of a station shown in FIG. 2, the switch machine installed in switch 1S has a means that has affiliation data indicating "affiliated with train detection section 2T" and data about the direction of the route to be cleared indicating, for example, the reverse position in the case of route 1R, normal position in the case of route 2R, reverse position in the case of route 3L, and normal position in the case of route 4L; and orients the switch to the reverse position when reservation information of the train detection section 2T contained in the received signaling message indicates "route 1R reserved," to the normal position when "route 2R reserved" is indicated, to the reverse position when "route 3L reserved" is indicated, and to the normal position when "route 4L reserved" is indicated. In this embodiment, it is possible to reduce the amount of information in the signaling message, resulting in communication cost reduction.

Furthermore, another embodiment can be considered which has a function to update and send an signaling message to the second subsequent device when it is not possible to send a signaling message to the immediate subsequent device due to a failure of that device or disconnection of the communication path between a current device and the immediate subsequent device; herein, when the subsequent device is a train detector, train on-track information of the corresponding section contained in the signaling message is updated to "presence on the track," and when the subsequent device is a switch machine, direction information of the corresponding switch contained in the signaling message is updated to "non-clear" and then the information is sent to the second subsequent device. In this case, it is possible to secure travel safety on the route that does not relate to the section concerned or the switch concerned, thereby increasing the operating rate.

Figure 16:
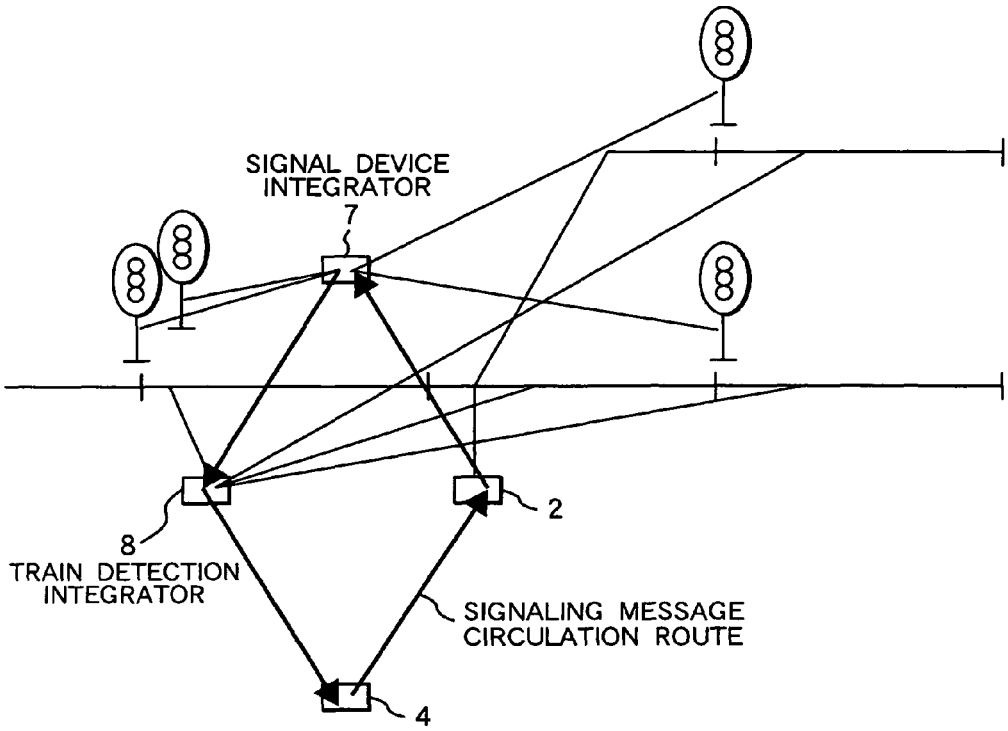
FIG. 16 shows another embodiment of a signaling system according to the present invention.

Furthermore, another embodiment can be considered which has an integrator for integrating a plurality of train detectors, switch machines and signal device controllers. For example, as shown in FIG. 16, another embodiment can be considered in which a signaling message is circulated among a signal device integrator 7 for batch-controlling signal device controllers, a train detection integrator 8 for batch-controlling train detectors, switch machine 2, and a route indicating device 4. In this case, it is possible to reduce the number of devices to which a signaling message is sent as well as reduce communication distance, which results in communication cost reduction.

Figure 17:
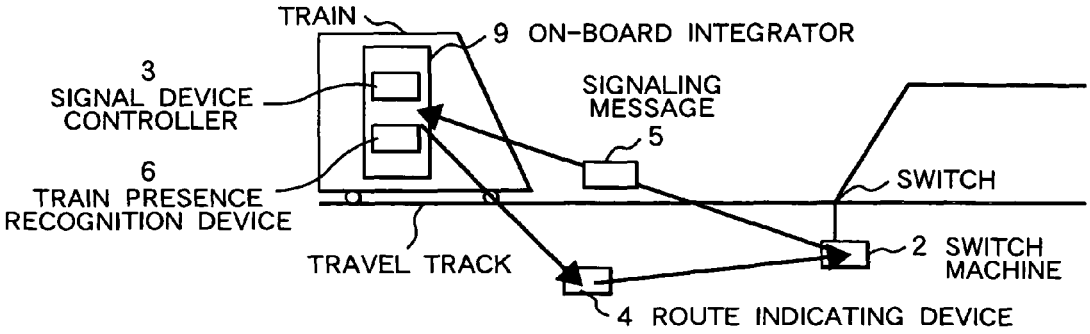
FIG. 17 shows another embodiment of a signaling system according to the present invention.

As an embodiment in which a train presence recognition device is installed on the train instead of installing a train detector on the travel track, for example, as shown in FIG. 17, an embodiment can be considered which has an on-board integrator 9 that integrates a signal device controller 3 with a train presence recognition device 6. In this embodiment, it is possible to reduce the number of signal devices disposed on the ground, resulting in the reduction of maintenance cost for the ground equipment. Furthermore, by providing an on-board integrator that integrates a signal device controller, route indicating device and a train presence recognition device on the train, it is possible to reduce the number of ground signal devices and ground route indicating devices, resulting in the reduction of maintenance cost for ground equipment and installation space.

As stated above, in a signaling system according to the present invention, a signaling message, which contains train on-track information and reservation information of a train detection section and direction information and reservation information of a switch, is circulated among a train detector, switch machine, signal device controller, and a route indicating device. Via the signaling message, the train detector can transmit the train detection result to the signal device controller and the route indicating device; the switch machine can transmit the switch condition to the signal device controller; the route indicating device can transmit route reservation to the switch machine and the signal device controller; and based on the transmitted train detection result, switch condition and route reservation, the signal device controller can transmit travel permission or travel non-permission for the assigned route to a train. Thus, the signaling system according to the present invention can safely route trains.

Moreover, in addition to railway trains, this kind of signaling system can be applied to automobiles, ships, airplanes, and the like that travel along a predetermined route by replacing the train detector's train detection function with a moving-body detection function. For example, a moving-body detection device and a signal device are disposed on a highway, in a harbor or at an airport, and a signaling message is circulated between the moving-body detection device and the signal device thereby securing travel safety. Also, this kind of signaling system can be applied to vehicles in an amusement park or a park. In such places, a moving-body detection device and a signal device are placed on a predetermined route or course, and a signaling message is circulated between the moving-body detection device and the signal device thereby securing safe operation of vehicles in the amusement park or park. Furthermore, by taking into consideration the safety, it is possible to provide a function for a driver or an operator to activate an emergency stop means such as a brake.

What is claimed is:

1. A distributed signaling system comprising a plurality of predetermined sections, a railway device arranged in each of the predetermined sections, and a route indicating device arranged in each of said predetermined section and operatively associated with said railway device to instruct a train route, wherein a message is circulated between said railway device and said route indicating device for decentralized processing by each said device and includes condition information of said railway device and track reservation information indicating whether a train has reserved the track for the indicated train detection section, and said railway device updates the condition information in said message based on the condition changes of said railway device and/or determines processing of said railway device based on the track reservation information, and said route indicating device then updates the track reservation information contained in said message based on train route indicating information received from outside, wherein said circulation is operative so that upon said railway device receiving said message, said railway device updates the condition information as needed, and sends said message after update to said route indicating device or another railway device, and upon said route indicating device receiving said message, said route indicating device updates the track reservation information if needed, and sends said message after update to said railway device.

2. A signaling system according to claim 1, wherein said railway device is a train detector that detects the location of a train, condition information of said train detector contained in said message is train on-track information indicating whether a train exists on the track in a train detection section of said train detector, and reservation information of said train detector contained in said message is track reservation information indicating whether the track is reserved for train in each train detection section of said train detector.

3. A signaling system according to claim 2, wherein said train detector comprises a function to update train on-track information contained in said message based on the condition of said train detector.

4. A signaling system according to claim 1, wherein said railway device is a switch machine that controls a point, condition information of said switch machine contained in said message is direction information indicating to which direction a point is oriented, and reservation information of said switch machine contained in said message is direction reservation information indicating to which direction said point is reserved.

5. A signaling system according to claim 4, wherein said switch machine comprises a function to determine a point's clearing direction based on direction reservation information contained in said message, and a function to update direction information contained in said message based on the condition of said point.

6. A signaling system according to claim 1, wherein said railway device is a signal device controller that controls a signal device, and said signal device controller comprises a function to determine whether to transmit travel permission or travel non-permission for a train to enter a section assigned to said signal device based on said condition information and said reservation information of the railway device contained in said message.

7. A signaling system according to claim 1, wherein said route indicating device comprises a means for receiving a route instruction for a train from outside, and a function to update reservation information of the railway device contained in said message based on said route instruction.

8. A signaling system according to claim 7, wherein said route indicating device comprises a function to determine whether to accept or reject a route instruction from outside based on condition information and reservation information of the railway device contained in said message.

9. A signaling system according to claim 1, wherein said railway device includes a train detector that detects the location of a train, a switch machine that controls a point, and a signal device controller that controls a signal device, condition information of said railway device contained in said message includes train on-track information indicating whether a train exists on the track in a train detection section of said train detector and direction information indicating to which direction a point is oriented, and reservation information of said railway device contained in said message includes track reservation information indicating whether the track is reserved for train in each train detection section of said train detector and direction reservation information indicating to which direction said point is reserved.

10. A signaling system according to claim 1, wherein a plurality of said railway devices are integrated.

* * * * *